US005255603A

United States Patent [19]

Sonneville et al.

[11] Patent Number: 5,255,603

[45] Date of Patent: Oct. 26, 1993

[54] INK RESERVOIR BAFFLE

[75] Inventors: Stephen T. Sonneville, Cincinnati; Charles E. Eberhard, Mason; Jeffery M. Vaughn, Cincinnati, all of Ohio

[73] Assignee: The Procter & Gamble Company, Cincinnati, Ohio

[21] Appl. No.: 16,647

[22] Filed: Feb. 12, 1993

[51] Int. Cl.[5] ..... B41F 31/06; B41L 27/08

[52] U.S. Cl. ..... 101/363

[58] Field of Search ..... 101/148, 207, 208, 209, 101/210, 350, 363, 364, 366; 118/429, 259

[56] References Cited

U.S. PATENT DOCUMENTS

| | | | |
|---|---|---|---|
| Re. 30,819 | 12/1981 | Schaeuble | 427/345 |
| 2,276,662 | 3/1942 | Matuschke | 101/363 |
| 2,377,482 | 6/1945 | Crafts | 101/157 |
| 2,821,912 | 2/1958 | Kasermann | 101/148 |
| 2,954,933 | 10/1960 | Clare | 239/220 |
| 2,967,480 | 1/1961 | Gerard | 101/364 |
| 2,983,222 | 5/1961 | Bakalars | 101/364 |
| 2,986,337 | 5/1961 | Clare | 239/220 |
| 3,010,393 | 11/1961 | Worthington | 101/363 |
| 3,771,165 | 11/1973 | Kurimoto et al. | 346/140 |
| 4,016,811 | 4/1977 | Zavodny | 101/148 |
| 4,158,333 | 6/1979 | Navi | 101/363 |
| 4,263,848 | 4/1981 | Matalia et al. | 101/350 |
| 4,373,443 | 2/1983 | Matalia et al. | 101/221 |
| 4,497,250 | 2/1985 | Dressler | 101/350 |
| 4,528,571 | 9/1985 | Sweet | 346/75 |
| 4,580,147 | 4/1986 | DeYoung et al. | 346/140 R |
| 4,603,633 | 8/1986 | Schubert et al. | 101/366 |
| 4,604,951 | 8/1986 | Ichikawa et al. | 101/153 |
| 4,688,516 | 8/1987 | Sommer | 118/410 |
| 4,791,879 | 12/1988 | Eklund et al. | 118/50 |
| 4,945,855 | 8/1990 | Eklund et al. | 118/407 |

*Primary Examiner*—J. Reed Fisher

*Attorney, Agent, or Firm*—Gerry S. Gressel; Larry L. Huston; Frederick H. Braun

[57] ABSTRACT

A printing apparatus is disclosed which includes an ink reservoir, an anilox roller partially submerged in the ink reservoir, and a baffle having an array of flow restrictors submerged in the ink in the reservoir. The baffle dissipates flow energy in the ink reservoir generated by rotation of the anilox roller. In one embodiment the flow restrictors comprise parallel pegs. In a second embodiment the flow restrictors comprise parallel bristle tufts.

19 Claims, 5 Drawing Sheets

INK RESERVOIR BAFFLE

The present invention is generally related to an apparatus for applying ink to a substrate. More particularly, this invention is concerned with a printing apparatus having a baffle for damping fluid motion in an ink reservoir.

BACKGROUND OF THE INVENTION

Ink may be used to make aesthetically pleasing designs on consumer products to increase sales of the consumer products. Applying ink to a substrate, such as a paper web, is well known in the art.

A known apparatus for applying ink to a substrate comprises an ink fountain, or reservoir, and a cylindrical roller rotatably mounted on a frame. The roller is partially submerged in the ink in the reservoir. The reservoir may be open to the atmosphere or, alternatively, may be closed and pressurized.

As the roller is rotated, the surface of the roller carries ink from the ink reservoir for subsequent transfer to the substrate. The partially submerged roller can be an anilox roller having an engraved surface with cells to enhance transfer of the ink from the reservoir. The anilox roller can form a nip with a plate cylinder. Ink transferred from the anilox roller to the plate cylinder is applied to a substrate passing between the plate cylinder and an impression cylinder.

Such a printing apparatus is disclosed in allowed U.S. patent application Ser. No. 07/917,528, Issue Batch No. J48, Apparatus for Applying Ink to a Substrate, filed Jul. 17, 1992 in the name of Leopardi, which application is incorporated by reference for the purpose of showing an ink reservoir and anilox roller assembly.

Generally, it is desirable to operate the printing apparatus at high speeds to decrease the unit cost of the printed substrate and provide a competitively priced product. However, attempts to increase the operating speed of the printing apparatus can result in undesirable variations in ink transfer to the anilox roller. Variations in ink transfer from the reservoir to the anilox roller can result in a low quality appearance of the ink patterns on the paper substrate due to concomitant variations in definition and intensity of the pattern.

Such variations are believed to be caused, at least in part, by energy and air directed into the ink in the reservoir by the anilox roller. As the anilox roller is rotated in the reservoir, energy is transferred from the surface of the anilox roller to the ink in the reservoir. The energy transferred to the ink increases as the rotational speed of the anilox roller increases.

The energy transferred to the ink can result in large scale turbulent flow of the ink within the reservoir. Ink flow caused by the rotation of the anilox roller is initially primarily in the machine direction which corresponds to the direction of rotation of the anilox roller. This ink flow can be turned by the walls of the reservoir, such that the large scale turbulent flow of the ink is directed along the length of the anilox roller in the cross machine direction. This cross machine direction is generally parallel to the axis of rotation of the anilox roller.

The rotating anilox roller can also carry a boundary layer of air on its surface. This boundary layer of air can be carried into the ink in the reservoir, especially if the reservoir is open to the atmosphere. The amount of air entrained in the ink also increases with the rotational speed of the anilox roller. The entrained air can result in undesirable foaming of the ink and prevent ink from entering the cells on the surface of the anilox roller.

The entrained air, in combination with the turbulence in the ink, can result in the formation of traveling ink waves along the length of the anilox roller. The troughs of the waves can cause uneven inking along the length of the anilox roller which in turn causes undesirable variations in the pattern on the inked substrate.

One known method of dissipating the flow energy of the ink caused by the anilox roller provides a series of parallel walls or plates positioned in the reservoir. Examples of plate baffles are disclosed in U.S. Pat. No. 2,276,662 issued Mar. 17, 1942, to Matuschke, U.S. Pat. No. 4,138,333 issued Jun. 19, 1979, to Navi, U.S. Pat. No. 4,373,443 issued Feb. 15, 1983, to Matalia et al., and U.S. Pat. No. 4,497,250 issued Feb. 5, 1985, to Dressler. Such plate baffles are disadvantageous because they divide the reservoir into compartments, and can thereby prevent proper mixing or circulation of the ink within the reservoir. Poor ink circulation can cause undesirable changes in ink properties, such as increased ink viscosity, which can result in variations in the intensity of the pattern printed on the substrate.

Further, plate baffles can prevent ink flow in a direction perpendicular to the plates, while permitting unrestricted flow parallel to the plates. Therefore, there is little or no dissipation of ink flow energy directed parallel to the plates.

Another known method of dissipating the flow energy of the ink caused by the anilox roller comprises filling the reservoir with a number of pads. Each pad comprises a three dimensional mesh of one or more plastic strands. An example of such a mesh is a scrubbing pad, such as is available from the Miles Corporation of Chicago, Illinois as Tuffy Dishwashing Pads. The plastic mesh pads can simply be placed in the reservoir, or can be supported in a mesh cage having a periphery that extends the length, width, and depth of the reservoir.

The above mentioned pads are effective in breaking up the flow of ink caused by the rotations of the anilox roller. However, the pads can prevent sufficient circulation of the ink within the reservoir, which can result in an undesirable change in ink properties, and variations in print intensity on the substrate. Insufficient circulation is believed to be due, at least in part, to the dense construction of the pads. The pads have a surface area to volume ratio of about 5.9 square centimeters per cubic centimeter (15 square inches per cubic inch), where the surface area is the surface area of the plastic strands and the volume is the volume enclosed by the periphery of the pad. This volume includes the volume occupied by the plastic strands and the volume of the ink between the strands.

The surface area to volume ratio provides one measure of damping in a baffle. Flow energy is dissipated as the ink flows over a surface, so that flow energy dissipation can be increased by increasing the surface area to volume ratio of the baffle. This surface area to volume ratio and restriction to flow can increase if the pads are compressed as they are loaded into the reservoir. Therefore, the spacing between strands (and the resulting restriction to flow through the pads) can vary depending on the number of pads placed in the reservoir and the manner in which they are packed in the reservoir.

The dense structure of the pads also results in the pads becoming clogged with paper fibers or other impurities in the ink, which clogging further reduces ink circulation. The pads must therefore be frequently cleaned or replaced. Each time the pads must be cleaned or replaced the printing apparatus must be shut down, resulting in lost production.

The pads are al so disadvantageous because they provide a restriction to flow which is substantially the same in any direction. An ink reservoir may have an ink inlet in the bottom of the reservoir. In such a reservoir, relatively unrestricted vertical flow from the inlet to the anilox roller is desirable, while restricted flows in the machine direction and cross machine direction are desirable in order to dissipate the flow energy of the ink caused by the rotation of the anilox roller.

Accordingly, it is an object of the present invention to provide a printing apparatus having a baffle with flow restrictors that dissipate flow energy in an ink reservoir while permitting circulation of the ink within the ink reservoir.

A further object of the present invention is to provide a baffle that prevents direct flow through the baffle in a machine direction and in a cross machine direction, while permitting circulation between flow restrictors in the machine and cross machine directions. Yet a further object of the present invention is to provide a baffle that restricts flow in the machine and cross machine directions substantially more than in a vertical direction normal to the machine and cross machine directions.

BRIEF SUMMARY OF THE INVENTION

The present invention comprises an apparatus for applying ink to a substrate, such as a paper web. The apparatus has a reservoir containing ink and a roller supported for rotation about a roller axis such that the roller is partially submerged in the ink in the reservoir. The apparatus further comprises a baffle for dissipating flow energy of the ink in the ink reservoir.

The baffle comprises an array of flow restrictors submerged in the reservoir. The array of flow restrictors extends along first and second mutually perpendicular directions. Each flow restrictor has a predetermined spacing from adjacent flow restrictors along the first and second mutually perpendicular directions. The first and second mutually perpendicular directions can correspond to the machine and cross machine directions.

In one embodiment, each flow restrictor comprises a tuft of bristles. In a second embodiment, each flow restrictor comprises a unitary peg. The flow restrictors can be generally parallel, with each flow restrictor extending from a first fixed end to a second free end closely spaced from the roller, and preferably extend the depth of the ink reservoir. In a preferred embodiment, the flow restrictors are staggered to prevent direct flow through the baffle in the machine and cross machine directions.

BRIEF DESCRIPTION OF THE DRAWINGS

While the Specification concludes with claims particularly pointing out and distinctly claiming the present invention, it is believed the present invention will be better understood from the following Specification taken in conjunction with the associated drawings wherein like parts are given the same reference numeral, and:

DETAILED DESCRIPTION OF THE INVENTION

Figure 1:
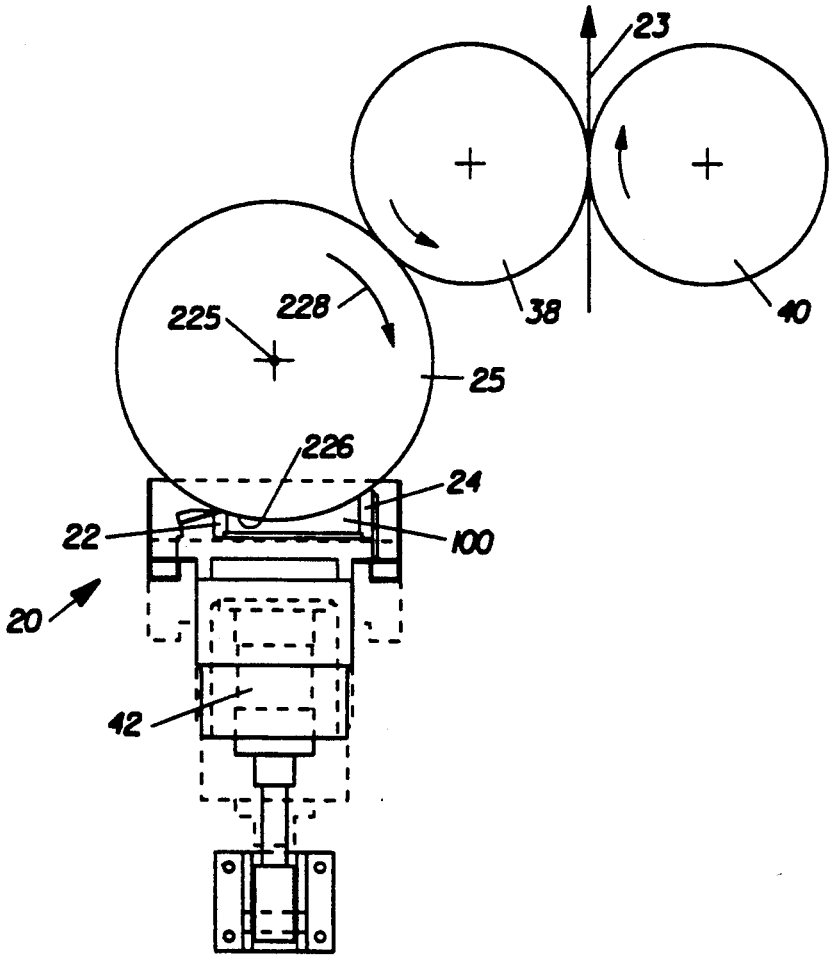
FIG. 1 is a schematic side elevational view of a printing apparatus according to the present invention.

FIG. 1 illustrates a printing apparatus 20 according to the present invention. The printing apparatus 20 includes a reservoir 22 for holding a volume of ink 24, a baffle 100 positioned in the reservoir 22, and a roller 25 supported for rotation about a horizontal axis 225. The roller 25 is partially submerged in the ink 24 in the reservoir 22 and can be an anilox roller 25 having an engraved surface 226. The reservoir 22 may be mounted on one or more hydraulic cylinders 42 for raising and lowering the reservoir 22 with respect to the roller 25. The apparatus 20 may further include a plate cylinder 38 and an impression cylinder 40.

The anilox roller 25 is parallel to and in contacting relationship with the plate cylinder 38. As the anilox roller 25 rotates in the direction indicated by arrow 228 in FIG. 1, a portion of the ink 24 in ink reservoir 22 is carried by the surface 226 of the anilox roller 25 for transfer to the plate cylinder 38. The plate cylinder 38 can be parallel to and positioned adjacent an impression cylinder 40. A substrate 23, such as a web of paper, can pass through a nip formed between the plate cylinder 38 and the impression cylinder 40. The ink 24 is applied to the substrate 23 in pattern established by the plate cylinder 38. Collectively, the anilox roller 25 and the plate cylinder 38 serve to remove a portion of the ink 24 from the reservoir 22 for application to the substrate 23.

FIG. 1 shows just one ink reservoir 22, baffle 100, anilox roller 25, and plate cylinder 38. However, it may be desirable to print a number of different patterns on substrate 23, such as a number of different colored patterns. Accordingly, it will be understood that a number of assemblies can be positioned around the central impression cylinder 40, each assembly including a reservoir 22 with a baffle 100, an anilox roller 25, and a plate cylinder 38. Each such assembly can apply a different color and pattern to substrate 23. Alternatively, instead of using a central impression cylinder, multiple printing apparatuses 20 can be arranged in series to print multiple colors on a substrate 23.

Figure 2:
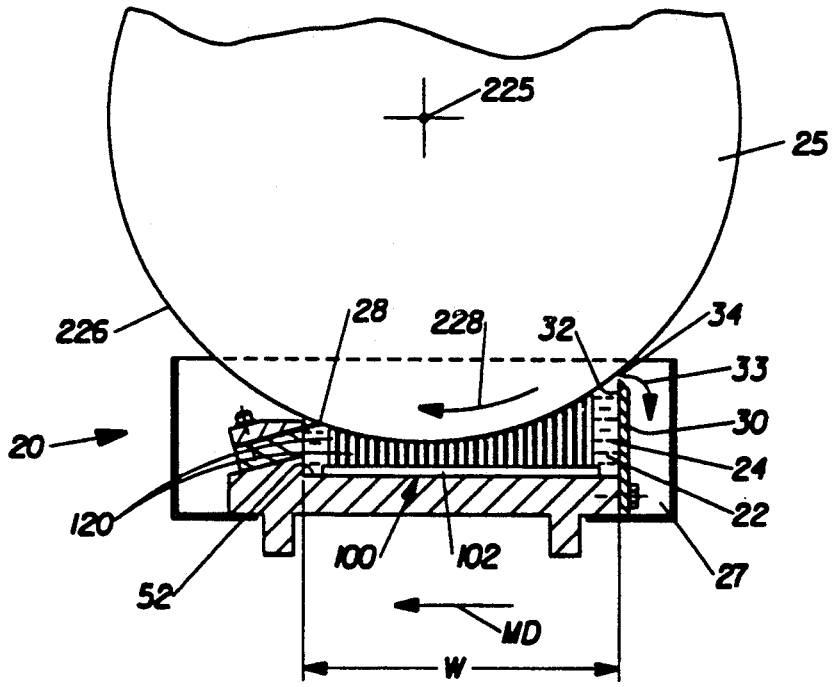
FIG. 2 is a cross-sectional view of the apparatus of FIG. 1 more clearly showing the baffle positioned in the ink reservoir.

Referring to FIG. 2 and examining components of the apparatus 20 in more detail , the reservoir 22 forms a chamber to hold the ink 24. The reservoir 22 should be constructed of a material which will not corrode or leach contaminants into the ink 24. The reservoir 22 may advantageously be made of stainless steel or a fiberglass epoxy.

One boundary of the reservoir 22 may be defined by a doctor blade 26. The doctor blade 26 is rigidly clamped at a proximal edge and has a distal edge 28 extending outwardly to contact the anilox roller 25 so that ink 24 is prevented from leaking out of the reservoir 22 when it is subjected to pressure, and to provide proper wiping of the ink 24 from the surface 226 of the anilox roller 25. The doctor blade 26 should be held in angular relation relative to the tangent to the anilox roller 25 at the distal edge 28 of the doctor blade 26. The included angle can be about 30 degrees to about 35 degrees.

Another boundary of the reservoir 22 may be defined by a weir 30. The weir 30 is upstream of the doctor blade 26 with respect to the direction of rotation 228 of anilox roller 25. The weir 30 is clamped at a proximal edge and extends to a distal edge 32 juxtaposed with the surface 226 of the anilox roller 25. The distal edge 32 of the weir 30 may be radially spaced from the surface 226 of anilox roller 25 a distance of about 1.5 to about 2.3 millimeters (0.060 to 0.090 inches) and defines the top of the weir 30. The distal edge 32 of the weir 30 may be bevelled, as shown, to provide less horizontal surface area for the accumulation of paper fibers or other debris.

The distal edge 32 of the weir 30 should be higher in elevation than the distal edge 28 of the doctor blade 26, so that the ink 24 maintains a constant static pressure head against the anilox roller 25. The differential elevation between the distal edge 32 and distal edge 28 can be about 2.5 to about 15 centimeters (1 to 6 inches).

The radial gap between the distal edge 32 of the weir 30 and the surface 226 of the anilox roller 25 results in a orifice 34 through which ink 24 may flow from the reservoir 22 into a spillway 27. As ink 24 is supplied to reservoir 22, the portion of ink 24 which is not transferred to the anilox roller 25 can flow over the top of the weir 30 and out of the reservoir 22, as shown by arrow 33 in FIG. 2. This process provides for controlled removal from the reservoir 22 of the ink 24 that is not transferred to the substrate 23. The spillway 27 may be open to the atmosphere.

Another boundary of the reservoir 22 is defined by a generally horizontal reservoir bottom surface 52. The bottom surface 52 can include ink supply passages (not shown) for supplying reservoir 22 with ink 24. The ink 24 that is removed through spillway 27 may be recirculated to re-enter the reservoir 22 through the ink supply passages in bottom surface 52. A fourth boundary of the reservoir 22 is defined by the portion of the surface 226 of anilox roller 25 submerged in the ink 24.

The ends of the reservoir 22 are defined by conventional contact seals, as are well known in the art. Suitable seals may be made according to the teachings of U.S. Pat. No. 4,581,995 issued Apr. 15, 1986 to Stone, which patent is incorporated herein by reference for the purpose of illustrating suitable end seals.

The volume of the reservoir 22 can be relatively small, such as about 7.6 to about 23 liters (2 to 6 gallons). The ink reservoir 22 can be very long in the direction of the axis 225 of anilox roller 25, compared to the cross-sectional area of the reservoir 22, so that a relatively small volume of ink is required to wet the length of the anilox roller 25. The ink reservoir 22 can be about 254 centimeters long (about 100 inches long). The ink reservoir 22 can have a width W (FIG. 2) of about 16.5 to about 17.8 centimeters (about 6.5 to about 7 inches), and a depth that varies across the width of the reservoir 22, from a minimum depth of about 2.2 centimeters (0.86 inches) at the bottom dead center position of the anilox roller 25 to a depth of about 7.6 centimeters (about 3.0 inches) at the weir 30.

The apparatus 20 can further comprise an ink supply means (not shown) for supplying ink 24 to the reservoir 22. A suitable ink supply means can include a pump, such as a positive displacement pump which continuously supplies ink 24 to the reservoir 22 through ink supply passages in the bottom surface 52 of the reservoir 22. The ink supply means should completely replenish the volume of the ink reservoir 22 at a rate of about once every 0.5 to 6 minutes. For the reservoir 22 described above, the ink supply means can supply ink 24 at the rate of between about 7.6 to 38 liters per minute (2 to 10 gallons per minute) to the reservoir 22.

The ink 24 is any liquid composition which may be applied onto a substrate 23 in a predetermined pattern. As used herein "a predetermined pattern" refers to any nonrandom desired array of application of ink 24 onto the substrate 23 and is inclusive of all combinations of patterns ranging from small individual dots to complete coating of the entire surface of the substrate 23. As used herein "ink" refers to any liquid composition applied to the substrate 23 and which remains thereon (even though components of the ink may evaporate). The ink 24 may, but need not, be visible to the naked eye.

The ink 24 can be a flexographic type ink having a defoaming agent to prevent entrained air from the boundary layer associated with the anilox roller 25 from causing the ink 24 to not completely coat the anilox roller 25 and to obviate streaking or fading of the desired pattern. The ink 24 can have a dynamic viscosity in the range of about 14 to about 22 seconds as measured in a Number 2 Shell cup. The ink 24 may be water based and have a pigment size of about 5 to about 25 microns. A suitable ink 24 is sold by the General Printing Ink division of the Sun Chemical Company of Fort Lee, N.J., as water based towel ink.

The roller 25 is the component of the apparatus 20 which removes ink 24 from the reservoir 22 for application of the ink 24 onto the substrate 23 in a metered fashion. The roller 25 can be generally cylindrical and can be an anilox roller 25 having small cells disposed on its surface 226 to carry ink 24 from the reservoir 22. Such an anilox roller 25 may have a laser engraved, ceramic coated surface finish of at least about 40 cells per centimeter (100 cells per inch) having a minimum depth of about 10 microns. The roller 25 has an axis 225 extending through the center of any cross-section, and is rotatable about this axis 225. For the reservoir 22 described above, the roller 25 can have a diameter of about 38.3 centimeters (15.1 inches).

The roller 25 is partially submerged in the ink 24 in the reservoir 22. As used herein, "partially submerged" refers to the condition where at any instant in time, a portion of the surface 226 of the roller 25 is wetted by the ink 24, and a portion of the surface 226 of the roller 25 is exposed to the atmosphere. The wetted portion of the surface 226 is intermediate the weir 30 and the doctor blade 26, as measured in the direction of rotation 228 of the roller 25.

Figure 3:
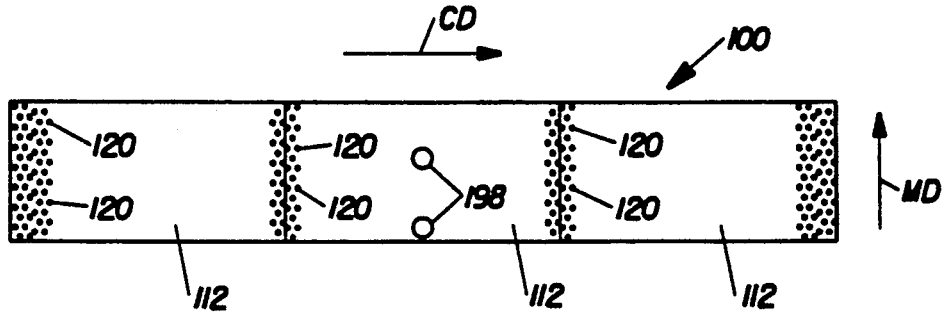
FIG. 3 is a schematic plan view of the baffle shown in FIG. 2.
Figure 4:
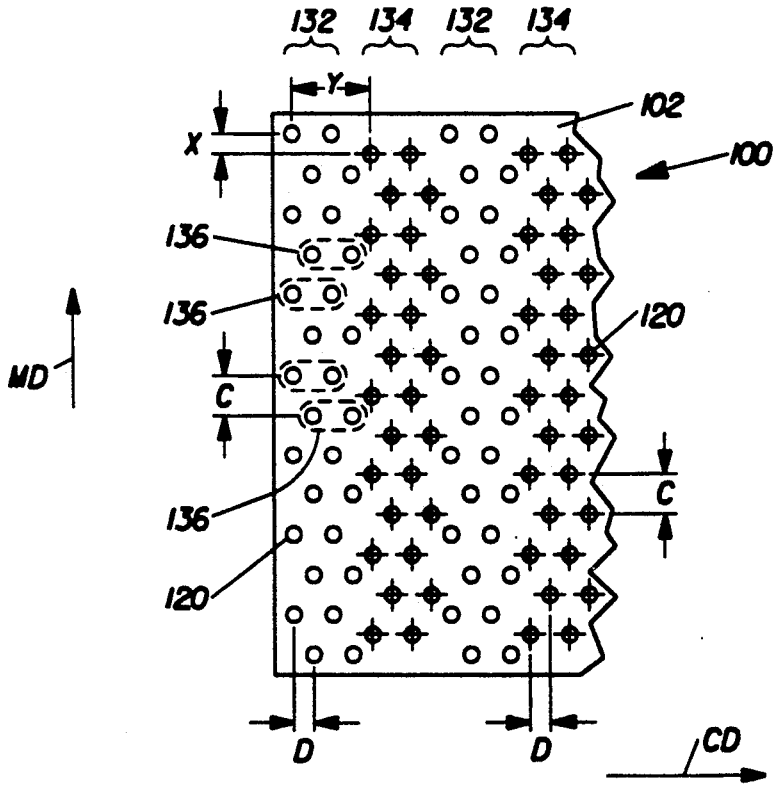
FIG. 4 is an enlarged schematic fragmentary plan view of the baffle in FIG. 2 showing an array of flow restrictors staggered to prevent direct flow through the baffle in any direction in the plane defined by the machine and cross machine directions.

Referring to FIGS. 2-4, the baffle 100 is positioned in the reservoir 22 and can be supported on the bottom surface 52 of the reservoir 22. The baffle 100 can simply rest on the bottom surface 52. Alternatively, the baffle 100 can be attached to the reservoir 22, such as by bolting the baffle 100 to the bottom surface 52.

The baffle 100 comprises an array of flow restrictors 120 submerged in the ink 24 in the reservoir 22. The flow restrictors 120 can extend from a baffle base 102 as shown in FIG. 2. The baffle base 102 preferably extends the length and width of the reservoir 22. The baffle base 102 can comprise a single piece, or alternatively, a number of adjacent segments 112 as shown in FIG. 3. The baffle base 102 can include one or more ink supply holes 198 extending through the baffle base 102 so that ink 24 can be supplied from the ink supply means to the ink reservoir 22. The baffle base 102 can be manufactured from any suitable material, including but not limited to plastics and metals. In one embodiment the baffle 100 can have a baffle base 102 formed from a material comprising polyvinyl chloride.

As shown in FIGS. 3 and 4, the array of flow restrictors 120 extends along first and second mutually perpendicular directions. Each flow restrictor 120 extends in a direction having a vector component in a third mutually perpendicular direction. In particular, the array of flow restrictors 120 can extend along a machine direction (MD in FIGS. 2–4) and a cross machine direction (CD in FIGS. 3–4), and each flow restrictor 120 can extend in a direction having a vector component perpendicular to the machine and cross machine directions. The machine direction is tangent to the direction of rotation 228 of anilox roller 25 at the lowest point of the surface 226 submerged in the ink 24 in reservoir 22. The cross machine direction is substantially parallel to the axis 225 of anilox roller 25.

Each flow restrictor 120 has a predetermined spacing from adjacent flow restrictors 120 along the first and second mutually perpendicular machine and cross machine directions. By "predetermined spacing" it is meant spacing that is set before the baffle 100 is positioned in the reservoir 22, and this spacing between flow restrictors 120 does not vary during operation of the apparatus 20. Two flow restrictors 120 are considered to be adjacent if an imaginary straight line can be drawn between the centers of the two flow restrictors without intersecting a third flow restrictor.

Figure 7:
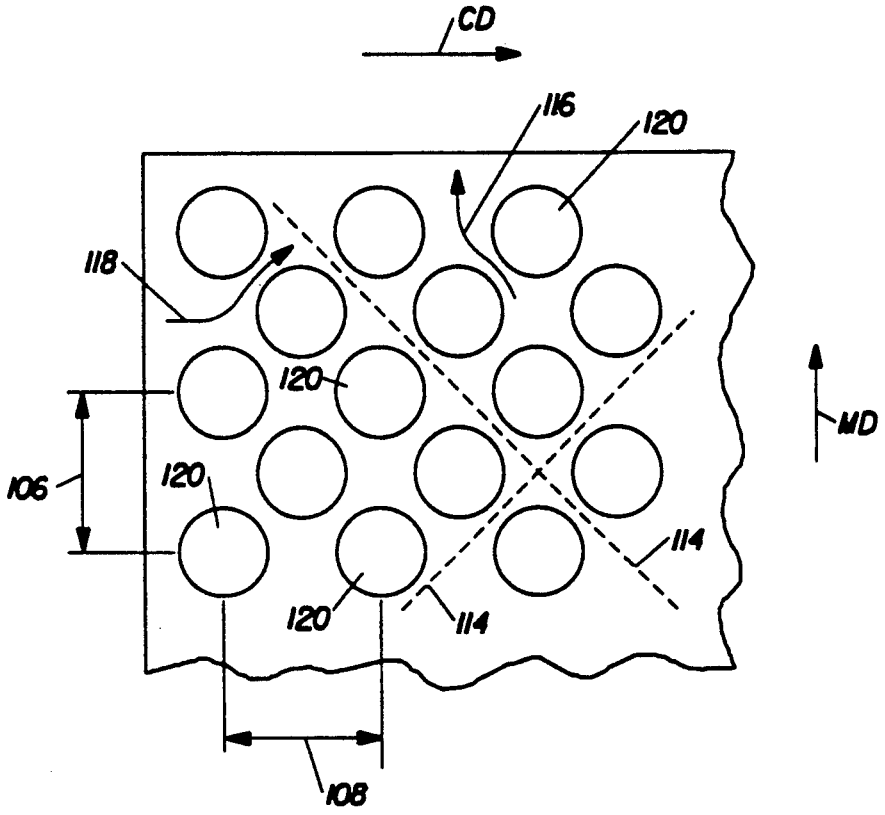
FIG. 7 is an enlarged schematic fragmentary plan view of the baffle in FIG. 2 showing an array of bilaterally staggered flow restrictors.

Referring to FIG. 7, a flow restrictor 120 is shown spaced a distance 106 in the machine direction, and a distance 108 in the cross machine direction, from adjacent flow restrictors 120. Each flow restrictor 120 is spaced from one or more adjacent flow restrictors 120 in both the machine and cross machine directions. In contrast to plate baffles which can prevent flow in one of the machine or cross machine directions, the array of flow restrictors 120 according to the present invention permits ink circulation in both the machine and cross machine directions.

The array of flow restrictors 120 should extend substantially the full length and width W of the reservoir 22 to prevent the development of large scale turbulent flow and wave formation in the ink 24 in any part of the reservoir 22. The flow restrictors 120 should also extend the full depth of the reservoir 22 to prevent the development of large scale turbulent flow and wave formation in the ink 24 between the baffle 100 and the bottom surface 52, or between the baffle 100 and the anilox roller 25.

The flow restrictors 120 should have a cross-sectional area having an aspect ratio close to unity. The cross-sectional aspect ratio of the flow restrictors 120 can be defined as the ratio of the width of a flow restrictor 120 in the cross machine direction to the width of the flow restrictor 120 in the machine direction as measured orthogonal to the length of the flow restrictor 120. A flow restrictor 120 having a large aspect ratio will have the characteristics of a plate extending in the cross machine direction. Likewise, a flow restrictor 120 having a small aspect ratio will have the characteristics of a plate extending in the machine direction. The flow restrictors should have an aspect ratio between 0.5 and 2.0, more preferably an aspect ratio between 0.75 and 1.25, and most preferably an aspect ratio of substantially 1.0. Cross-sectional shapes providing an aspect ratio of substantially 1.0 include, but are not limited to, circles and squares. The flow restrictors 120 shown in FIGS. 2–7 have generally circular cross-sections.

Positioning of the flow restrictors 120 in the machine and cross machine directions is important to the proper operation of the baffle 100. The flow energy of the ink 24 caused by the rotation of the anilox roller 25 is initially directed along the machine direction, corresponding to the direction of rotation of anilox roller 25. This flow energy can be redirected by the geometry of the ink reservoir 22 such that large scale turbulence of the ink 24 is directed along the cross machine direction. This flow energy in the cross machine direction can result in the aforementioned waves along the length of the anilox roller 25. It is desirable to position the flow restrictors 120 to redirect the ink flow at spaced intervals and thereby dissipate the energy of the ink flow caused by anilox roller 25.

Accordingly, the flow restrictors 120 are preferably staggered to prevent direct flow through the baffle 100 in both the machine and cross machine directions. Direct flow through the baffle 100 in the machine direction refers to flow through the entire width of the baffle 100 and reservoir 22 without redirection in the cross machine direction. An example of such a flow would be a straight line, or line of sight flow of the ink 24 through the width of the baffle 100 and reservoir 22. Direct flow through the baffle 100 in the cross machine direction refers to flow through the entire length of the baffle 100 and reservoir 22 without redirection in the machine direction.

FIG. 7 shows flow restrictors 120 bilaterally staggered in the machine and cross machine directions. Flow in the machine direction is redirected in the cross machine direction, as shown by arrow 116, and flow in the cross machine direction is redirected in the machine direction, as shown by the arrow 118. The array of flow restrictors 120 in FIG. 7 dissipates the energy of the flow caused by the rotation of anilox roller 25, while permitting circulation of ink 24 in both the machine and cross machine directions. The array shown in FIG. 7 has the disadvantage that direct flow through the length or width of the baffle 100 can occur along diagonal lines, such as those indicated by the flow lines 114. Flow directed along flow lines 114 is not redirected by flow restrictors 120 in FIG. 7.

FIG. 4 shows a preferred array of flow restrictors 120 which are staggered to prevent direct flow through the length or width of the baffle 100 along any line lying in the plane defined by the machine and cross machine directions. The flow restrictors 120 are arranged in first and second repeating patterns 132 and 134. The patterns 132 and 134 alternate in the cross machine direction. The flow restrictors 120 in pattern 132 are shown as an open circle, and the flow restrictors 120 in pattern 134 are shown as a cross superimposed on an open circle.

The patterns 132 and 134 are substantially the same, with each pattern 134 spaced from an adjacent pattern 132 by an offset X parallel to the machine direction and an offset Y parallel to the cross machine direction. Each of the patterns 132 and 134 have a series of paired flow restrictors 120. Such a pair of flow restrictors 120 is indicated by numeral 136 in FIG. 4. Each pair 136 is aligned in the cross machine direction. Each pair 136 is spaced from an adjacent pair 136 by an offset C parallel to the machine direction and an offset D parallel to the cross machine direction. The direction of the offset D is reversed for every other pair 136 so that the patterns 132 and 134 extend across the width of the baffle 100 in substantially the machine direction. The offset C is greater than the offset X, and can be about two times X. The offset D is less than the offset Y, and can be about one-quarter Y. The offsets X and D can be approximately equal. The offsets C, D, X, and Y are measured from the centers of the cross-sections of the flow restrictors 120. In an alternative embodiment, the arrangement of flow restrictors 120 shown in FIG. 4 can be rotated in the plane defined by the machine and cross machine directions. For instance, the arrangement of flow restrictors 120 shown in FIG. 4 can be rotated ninety degrees so that offsets X and C are measured parallel to the cross machine direction and offsets Y and D are measured parallel to the machine direction.

In a preferred embodiment, the cross-sectional width of the flow restrictors 120 in the machine and cross machine directions approximates the offsets X and D. For instance, in one embodiment the flow restrictors can have a circular cross-section with a diameter from about 0.48 centimeters (0.1875 inch) to about 0.635 centimeters (0.25 inch). The offsets X and D can be about 0.635 centimeters (0.25 inch). The offset Y can be about 2.54 centimeters (1.0 inch) and the offset C can be about 1.27 centimeters (0.5 inch).

Figure 5:
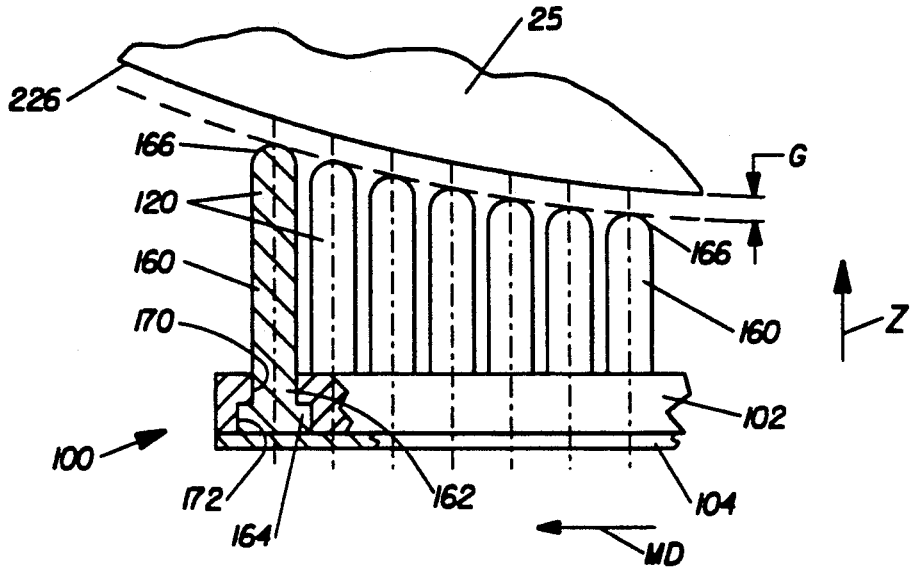
FIG. 5 is a schematic fragmentary cross-sectional view of the baffle shown in FIG. 2, shown partially in cutaway, wherein the baffle flow restrictors comprise an array of generally parallel unitary pegs.

Referring to FIG. 5, the flow restrictors 120 can comprise generally parallel unitary pegs 160. The pegs 160 are preferably formed, such as by molding, from a material that does not have a high affinity for ink particles. Examples of suitable materials from which pegs 160 can be formed include, but are not limited to, polypropylene and acetal resins. Suitable acetal resins are commercially available from the Dupont Corporation Engineering Polymers Group of Wilmington, Del. under the tradename Delrin, and from the Hoechst Celanese Corporation of Chatham, N.J. under the tradename Celcon.

Each peg 160 extends from a first fixed end 162 to a second free end 166 closely spaced from the surface 226 of anilox roller 25. The pegs 160 can extend in a direction substantially perpendicular to the machine and cross machine directions. By "closely spaced" it is meant that the ends 166 are spaced from the surface 226 by a radial gap G which is no more than 1.27 centimeters (0.5 inch) and preferably no more than 0.635 centimeters (0.25 inch). The term "closely spaced" is also meant to include the condition where the ends 166 of the pegs 160 lightly contact the surface 226, although it will be understood that such light contact may be detrimental to the surface 226 or the pegs 160, and will be eliminated due to wear caused by continued rotation of roller 25. Generally, it is desirable to make the gap G as small as possible to eliminate the possibility of wave formation in the gap G.

The radial gap G can be maintained by varying the length of the pegs 160 as a function of position along the width W of the reservoir 22, as shown in FIG. 5. Alternatively, the pegs 160 could have a uniform length, and the baffle base 102 or bottom surface 52 could formed to have a circular profile that matches the curvature of anilox roller 25.

The pegs 160 can be generally cylindrical and extend through holes 170 formed in the baffle base 102. The holes 170 can have a counter-bore 172 which receives an enlarged portion 164 of the fixed peg end 162. A retaining plate 104, which can comprise a sheet of stainless steel, can be attached to the bottom surface of baffle base 102 to retain the pegs 160 in their respective holes 170.

The pegs 160 are preferably arranged as shown in FIG. 4 to prevent direct flow along any line in the plane defined by the machine and cross machine directions. The pegs 160 can have a diameter of at least 0.48 centimeters (0.1875 inch) and preferably at least 0.635 centimeters (0.25 inch) for the spacing described above with reference to FIG. 4. This arrangement of sizing and spacing of pegs 160 provides a surface area to volume ratio of at least 0.87 square centimeters per cubic centimeter (2.2 square inches per cubic inch), where the surface area is the surface area of the pegs 160 extending above the baffle base 102, and the volume is the volume occupied by the pegs 160 and ink 24 between the pegs 160.

The array of parallel pegs 160 advantageously provides a relatively high value of flow restriction along the machine and cross machine directions and a relatively low value of flow restriction perpendicular to the machine and cross machine directions. The array of parallel pegs 160 provides a relatively high value of flow restriction in both the machine and cross machine directions by redirecting flow along the machine and cross machine directions. The parallel pegs 160 thereby dissipate the flow energy generated by the rotating anilox roller 25. In contrast, the array of parallel pegs 160 provides a relatively unrestricted flow in the Z direction (FIG. 5) perpendicular to the machine and cross machine directions because the ink 24 flowing along the Z direction is not redirected by the pegs 160. Therefore, the ink 24 entering the reservoir 22 through the ink supply passages in the bottom surface 52 has a relatively unrestricted flow path to the surface 226 of the anilox roller 25.

The array of parallel pegs 160 also provides a baffle 100 which requires minimal maintenance. The smooth, unbroken cylindrical surfaces and rounded free ends 166 of the pegs 160 do not tend to catch or hold reservoir debris such as paper fibers. The printing apparatus 20 can therefore be run for extended periods before the baffle 100 requires cleaning. When cleaning is required, the pegs 160 can be cleaned by spraying with a hose and water.

Figure 6:
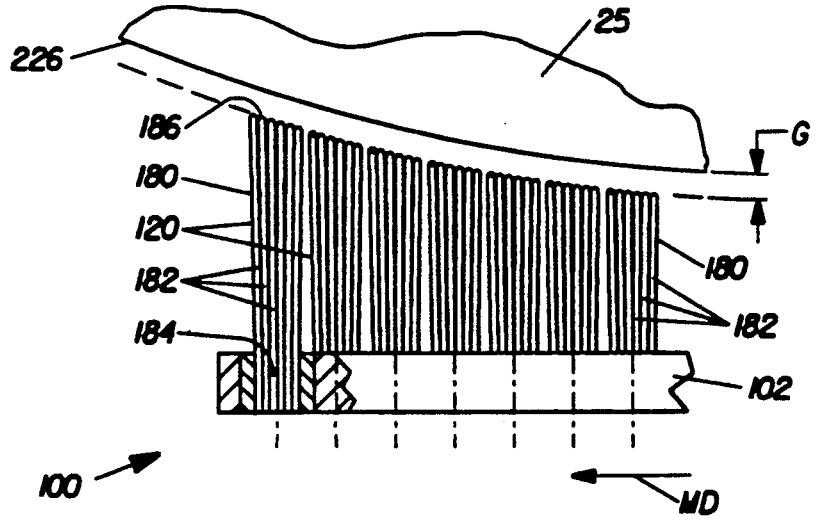
FIG. 6 is a schematic fragmentary cross-sectional view of the baffle shown in FIG. 2, shown partially in cutaway, wherein the baffle flow restrictors comprise an array of generally parallel bristle tufts.

Referring to an alternate embodiment shown in FIG. 6, the flow restrictors 120 can comprise generally parallel bristle tufts 180. Each bristle tuft 180 comprises a plurality of bristles 182. The bristles 182 are preferably made from a material such as polypropylene that does not have a high affinity for ink particles.

Each bristle tuft 180 extends from a first fixed end 184 to a second free end 186 closely spaced from the surface 226 of anilox roller 25. By "closely spaced" it is meant that the ends 186 are spaced from the surface 226 by a radial gap G which is no more than 1.27 centimeters (0.5 inch) and preferably no more than 0.635 centimeters (0.25 inch). The term "closely spaced" is also meant to include the condition where the ends 186 of the bristle tufts 180 lightly contact the surface 226, although it will be understood that such light contact may be detrimental to the surface 226 or the bristle tufts 180 and will be eliminated due to wear with continued rotation of roller 25. Generally, it is desirable to make the gap G as small as possible to eliminate the possibility of wave formation in the gap G.

The radial gap G can be maintained by varying the length of the bristle tufts 180 as a function of position along the width W of the reservoir 22, as shown in FIG. 6. Alternatively, the bristle tufts 180 could have a uniform length, and the baffle base 102 or bottom surface 52 could be formed to have a circular profile that matches the curvature of anilox roller 25.

The bristle tufts 180 are preferably arranged as shown in FIG. 4 to prevent direct flow along any line in the plane defined by the machine and cross machine directions. The bristle tufts 180 can have a generally cylindrical cross-section, with a diameter of about 0.48 centimeters (0.1875 inch) measured adjacent the baffle base 102.

In one embodiment each bristle tuft 180 can include an average of about 55 bristles 182, with each bristle 182 having a generally circular cross-section having a diameter of about 0.051 centimeters (0.020 inch). The bristle tufts 180 can be arranged in the patterns shown in FIG. 4 with the spacing described above with reference to FIG. 4. Such an arrangement of sizing and spacing of the bristle tufts 180 provides a surface area to volume ratio of about 4.5 square centimeters per cubic centimeter (11.5 square inches per cubic inch), where the surface area is the surface area of the bristles 182 extending above the baffle base 102, and the volume is the volume occupied by the bristle tufts 180 and the ink 24 between the bristle tufts 180, as well as the volume of the ink 24 between the individual bristles 182.

In a second embodiment each bristle tuft 180 can include an average of about 35 bristles 182, with each bristle 182 having a generally rectangular cross-section about 0.051 centimeters (0.020 inch) wide and 0.076 centimeters (0.030 inch) thick. The bristle tufts 180 can be arranged in the patterns shown in FIG. 4 with the spacing described above with reference to FIG. 4. Such an arrangement of sizing and spacing of the bristle tufts 180 provides a surface area to volume ratio of about 4.3 square centimeters per cubic centimeter (11.0 square inches per cubic inch), where the surface area is the surface area of the bristles 182 extending above the baffle base 102, and the volume is the volume occupied by the bristle tufts 180 and the ink 24 between the bristle tufts 180, as well as the volume of the ink 24 between the individual bristles 182.

Without being limited by theory, it is believed that the effectiveness of a particular baffle and the amount of baffling that is appropriate will be a function of a number of factors, such as the geometry of the fountain 22, the speed of the anilox roller 25, the desired printing intensity on the substrate 23, and the viscosity of the ink 24. For the fountain 22 described above and an ink viscosity of about 16 seconds measured in a Number 2 Shell cup, the baffle 100 shown in FIGS. 2–6 permits anilox roller 25 speeds in excess of about 490 meters per minute (1600 feet per minute) without large scale ink metering variation.

While particular embodiments of the invention have been illustrated and described, various changes and modifications can be made to the present invention without departing from the spirit and scope of the present invention. The appended claims are intended to cover all such changes and modifications.

I claim:

1. An apparatus for applying ink to a substrate, the apparatus comprising:

a reservoir containing ink;

a roller supported for rotation about a roller axis, the roller partially submerged in the ink in the reservoir and having a roller surface for transferring ink from the reservoir; and a baffle comprising an array of flow restrictors at least partially submerged in the ink in the reservoir, the array of flow restrictors extending along first and second mutually perpendicular directions, each flow restrictor having a predetermined spacing from adjacent flow restrictors along the first and second mutually perpendicular directions, each flow restrictor extending from a fixed end to a free end closely spaced from the roller surface, and each flow restrictor extending in a direction having a vector component in a third mutually perpendicular direction.

2. The apparatus recited in claim 1 wherein each flow restrictor comprises a tuft of bristles.

3. The apparatus recited in claim 1 wherein each flow restrictor comprises a peg.

4. The apparatus recited in claim 1 wherein the flow restrictors are staggered to prevent direct flow through the baffle in a machine direction corresponding to the direction of rotation of the roller.

5. The apparatus recited in claim 1 wherein the flow restrictors are staggered to prevent direct flow through the baffle in a cross machine direction substantially parallel to the roller axis.

6. The apparatus recited in claim 4 wherein the flow restrictors are staggered to prevent direct flow through the baffle in a cross machine direction substantially parallel to the roller axis.

7. The apparatus recited in claim 6 wherein the flow restrictors are staggered to prevent direct flow through the baffle along any line lying in a plane defined by the machine and cross machine directions.

8. The apparatus recited in claim 7 having the flow restrictors arranged in first and second repeating patterns alternating in the cross machine direction, wherein the first and second repeating patterns are substantially the same, and each second pattern is spaced from an adjacent first pattern by an offset X parallel to the machine direction and an offset Y parallel to the cross machine direction; and wherein each pattern comprises a plurality of paired flow restrictors wherein each pair of flow restrictors is aligned in the cross machine direction, and each pair of flow restrictors is spaced from an adjacent pair of flow restrictors by an offset C parallel to the machine direction and an offset D parallel to the cross machine direction, with C greater than X and D less than Y, and wherein the direction of the offset D is reversed for every other pair of flow restrictors.

9. The apparatus recited in claim 6 wherein the flow restrictors have a cross-sectional aspect ratio of between 0.5 to 2.0.

10. The apparatus recited in claim 9 wherein the flow restrictors have a cross-sectional aspect ratio of between 0.75 to 1.25.

11. The apparatus recited in claim 10 wherein the flow restrictors have a cross-sectional aspect ratio substantially equal to 1.0.

12. The apparatus recited in claim 11 wherein the flow restrictors have a generally circular cross-section.

13. The apparatus recited in claim 6 wherein the baffle has a surface area to volume ratio less than 5.9 centimeters squared per cubic centimeter.

14. The apparatus recited in claim 13 wherein the baffle has a surface area to volume ratio between 0.87 centimeters squared per cubic centimeter and 4.53 centimeters squared per cubic centimeter.

15. The apparatus recited in claim 6 wherein the flow restrictors extend generally parallel.

16. An apparatus for applying ink to a substrate, the apparatus comprising:

a reservoir containing ink;

a roller supported for rotation about a roller axis, the roller partially submerged in the ink in the reservoir and having a roller surface for transferring ink from the reservoir; and a baffle comprising an array of generally parallel cylindrical pegs at least partially submerged in the ink in the reservoir, the array of pegs extending at least partially the length and width of the reservoir, each peg extending from a first fixed end to a second free end closely spaced from the roller surface, and each peg having a predetermined spacing from adjacent pegs along a machine direction corresponding to the direction of rotation of the roller and a cross machine direction substantially parallel to the roller axis.

17. The apparatus recited in claim 16 wherein the pegs are staggered to prevent direct flow through the baffle in the machine and cross machine directions.

18. An apparatus for applying ink to a substrate, the apparatus comprising:

a reservoir containing ink;

a roller supported for rotation about a roller axis, the roller partially submerged in the ink in the reservoir and having a roller surface for transferring ink from the reservoir; and a baffle comprising an array of generally parallel bristle tufts at least partially submerged in the ink in the reservoir, the array of bristle tufts extending at least partially the length and width of the reservoir, each bristle tuft extending from a first fixed end to a second free end closely spaced from the roller surface, and each bristle tuft having a predetermined spacing from adjacent bristle tufts along a machine direction corresponding to the direction of rotation of the roller and a cross machine direction substantially parallel to the roller axis.

19. The apparatus recited in claim 18 wherein the bristle tufts are staggered to prevent direct flow through the baffle in the machine and cross machine directions.

* * * * *

UNITED STATES PATENT AND TRADEMARK OFFICE

CERTIFICATE OF CORRECTION

PATENT NO. : 5,255,603

DATED : OCTOBER 26, 1993

INVENTOR(S) : STEPHEN T. SONNEVILLE, CHARLES E. EBERHARD, JEFFREY M. VAUGHN

It is certified that error appears in the above-identified patent and that said Letters Patent is hereby corrected as shown below:

Title page, item [56],

| | |
|---|---|
| Under References Cited | "4,528,571 9/1985" should read --4,528,571 7/1985--. |
| Column 3, line 8 | "are al so disadvantageous" should read --are also disadvantageous--. |

Signed and Sealed this

Eleventh Day of October, 1994

Bruce Lehman

*Attest:*

BRUCE LEHMAN

*Attesting Officer*

*Commissioner of Patents and Trademarks*